United States Patent [19]

Spitzer et al.

[11] 3,970,219

[45] July 20, 1976

[54] AEROSOL CONTAINERS FOR FOAMING AND DELIVERING AEROSOLS AND PROCESS

[76] Inventors: Joseph George Spitzer, 44 Coconut Row, Palm Beach, Fla. 33480; Marvin Small, 1100 Park Ave., New York, N.Y. 10028; Lloyd I. Osipow, 2 Fifth Ave., New York, N.Y. 10011; Dorothea C. Marra, 107 Fernwood Road, Summit, N.J. 07901

[22] Filed: Mar. 3, 1975

[21] Appl. No.: 554,388

[52] U.S. Cl. ..... 222/1; 222/136; 222/187; 222/189; 222/190; 222/402.24; 239/308; 239/326

[51] Int. Cl.[2] ..... B65D 83/14; B65D 83/00

[58] Field of Search ..... 222/1, 129, 136, 187, 222/189, 190, 192, 195, 402.1, 402.21, 402.22, 402.23, 402.24; 239/304, 308, 326, 343, 370

[56] References Cited

UNITED STATES PATENTS

| | | | |
|---|---|---|---|
| 3,069,098 | 12/1962 | Frangos et al. | 239/326 X |
| 3,134,518 | 5/1964 | Sagarin et al. | 222/187 X |
| 3,428,222 | 2/1969 | Wright | 222/190 X |
| 3,471,064 | 10/1969 | Micallef | 222/190 X |

FOREIGN PATENTS OR APPLICATIONS

| | | |
|---|---|---|
| 1,150,945 | 1/1958 | France |

*Primary Examiner*—Robert B. Reeves
*Assistant Examiner*—David A. Scherbel

[57] ABSTRACT

An aerosol container is provided for foaming a liquid aerosol composition therein prior to expulsion from the container and then expelling the resulting foamed aerosol composition comprising, in combination, a pressurizable container having a valve movable between open and closed positions, with a valve stem and a foam-conveying passage therethrough in flow connection with a delivery port; at least two separate compartments in the container, of which a first compartment is in direct flow connection with the valve passage, and a second compartment is in flow connection with the valve passage only via the first compartment; and a porous bubbler having through pores interposed between the first and second compartments with the through pores communicating the two compartments, the pores being of sufficiently small dimensions to restrict flow of propellant gas from the second compartment therethrough and form bubbles of such gas in liquid aerosol composition across the line of flow from the porous bubbler to the valve, thereby to foam the aerosol composition upon opening of the valve to atmospheric pressure, and to expel foamed aerosol composition through the open valve. A process is also provided for foaming liquid aerosol compositions with a propellant gas prior to expulsion from an aerosol container.

51 Claims, 8 Drawing Figures

AEROSOL CONTAINERS FOR FOAMING AND DELIVERING AEROSOLS AND PROCESS

Aerosol sprays are now widely used, particularly in the cosmetic, topical pharmaceutical and detergent fields, for delivery of an additive such as a cosmetic, pharmaceutical or cleaning composition to a substrate such as the skin or other surface to be treated. Aerosol compositions are especially widely used as antiperspirants, to direct the antiperspirant to the skin in the form of a finely divided spray.

Conventional aerosol containers are designed to confine liquefied propellant gases under high pressure and to deliver a liquid spray from the delivery port of the valve. It is however a difficult design problem to deliver a spray with sufficiently fine droplets, susceptible of being so directed as to travel a considerable distance through the air, in the direction in which the delivery port of the valve is pointed.

The problem is especially difficult when the aerosol composition includes solid particles dispersed in a liquid vehicle, as in the case of antiperspirant compositions, since the solid particles readily clog small valve orifices. If a coarse liquid spray with large droplets is formed, there is excessive drip at the nozzle, and the material can even be squirted out in the form of a liquid stream, which rapidly runs off the surface on which is is deposited.

Much effort has accordingly been directed to the design of valves and valve delivery ports, nozzles or orifices which are capable of delivering finely divided sprays, of which U.S. Pat. Nos. 3,083,917 and 3,083,918, patented Apr. 2, 1963, to Abphanalp et al, and 3,544,258, dated Dec. 1, 1970, to Presant et al, are exemplary. The latter patent describes a type of valve which is now rather common, giving a finely atomized spray, and having a vapor tap, which includes a mixing chamber provided with separate openings for the vapor phase and the liquid phase to be dispensed into the chamber, in combination with a valve actuator or button of the mechanical breakup type. Such valves provide a soft spray with a wirling motion. Another design of other valves of this type is described in U.S. Pat. No. 2,767,023. Valves with vapor taps are generally used where the spray is to be applied directly to the skin, since the spray is less cold.

These types of valves are effective in providing fine sprays. However, they require high proportions of propellant. If a vapor tap is provided, the valve tends to consume a larger than normal amount of propellant gas, because more peopellant gas is vented with each squirt. Such valves therefore require aerosol compositions having a rather high proportion of propellant. This is a problem today, partially because the fluorocarbon propellants, which are widely favored, are thought to be deleterious, in that they are believed to accumulate in the stratosphere, where they may possibly interfere with the protective ozone layer there. Moreover, they have become rather expensive, and are presently in short supply.

Another problem with such valves is that since they deliver a liquid mixture, and have valve passages in which a residue of liquid remains following the squirt, evaporation of the liquid in the valve may lead to deposition of solid materials, and valve clogging. This problem has given rise to a number of expedients to prevent the deposition of solid materials in a form which can result in clogging.

Special designs of the delivery port and valve passages have been proposed, to prevent the deposit of solid materials in a manner such that clogging can result. U.S. Pat. No. 3,544,258 provides a structure which is especially designed to avoid this difficulty, for example. Such designs result however in a container and valve system which is rather expensive to produce, complicated to assemble because of the numerous parts, and more prone to failure because of its complexity.

in accordance with the instant invention, it has been determined that less propellant is required to obtain a fine spray if, instead of delivering a liquid aerosol composition to the valve of an aerosol container, one delivers a foamed aerosol composition. Conventional aerosol containers rely on a combination of small orifices in the valve and the rapid boiling of a high proportion of propellant to break up the liquid stream of aerosol composition into fine droplets. In accordance with the instant invention, fine droplets are formed from foamed aerosol composition, and at least in part are formed upon collapse of thin foam cell walls into fine droplets. The propellant serves to foam the liquid within the container, forming a foamed aerosol composition, and propel both any foam and any droplets that form when the foam collapses from the container through the valve and delivery port.

With conventional aerosol containers, a substantial proportion of the propellant is in liquid form as the aerosol composition passes through the valve and delivery port. Propellant evaporates as the spray travels through the air, and it continues to evaporate after the spray has landed on a surface. The heat of vaporization is taken from the surface, and the spray consequently feels cold. This is wasteful of propellant, as is readily evidenced by the coldness of sprays from conventional aerosol containers. In contrast, in the instant invention the propellant is in gaseous form when expelled with the liquid. The propellant is not wasted, therefore, and since there is substantially no liquid propellant to take up heat upon vaporization, the spray is not cold.

Numerous attempts have been made in the past to achieve fine sprays using compressed gases. These have been completely unsuccessful. Only coarse sprays and foams were obtained. In accordance with the invention, fine sprays are readily obtained, with the propellant in gaseous form.

In the instant invention, the aerosol composition emerging from the delivery port of the aerosol container can be in the form of a foam, or of a liquid, or both foam or droplets of foam and droplets of liquid. Reference to "foamed aerosol composition" will accordingly be understood to include both foams and liquids and mixed foams and liquids. To expel droplets of foam requires a liquid that readily produces small, stable foam bubbles. If the foam bubbles are sufficiently small, they can pass through the valve orifices without breaking. Also, larger bubbles may collapse, and re-form as small bubbles. To deliver a foam rather than droplets of collapsed foam, a valve with large orifices is used as with conventional aerosol containers.

Further in accordance with the invention, the rate of delivery of aerosol composition from the delivery port can be determined and limited by the size and number of bubbler pores. This permits the use of simple valves with large openings. Since the flow restrictions (the bubbler pores) are in contact with liquid, rather than with air-dried solid residues, the likelihood of clogging is practically zero.

The aerosol containers in accordance with the invention accordingly foam an aerosol composition therein prior to expulsion from the container, and then expel the resulting foamed aerosol composition. These aerosol containers comprise, in combination, a pressurizable container having a valve movable between open and closed positions, with a valve stem, and a foam-conveying passage therethrough, in flow connection with a delivery port; bias means for holding the valve in a closed position; and means for manipulating the valve against the bias means to an open position, for expulsion of aerosol composition foamed within the container via the valve passage and delivery port; means defining at least two separate compartments in the container, of which a first compartment is in direct flow connection with the valve passage, and a second compartment is in flow connection with the valve passage only via the first compartment; and porous bubbler means having through pores interposed between the first and second compartments with the through pores communicating the compartments, the pores being of sufficiently small dimensions to restrict flow of propellant gas from the second compartment therethrough and form bubbles of such gas in liquid aerosol composition across the line of flow from the bubbler to the valve, thereby to foam the aerosol composition upon opening of the valve to atmospheric pressure, and to expel foamed aerosol composition through the open valve.

The process further provides a way of dispensing a fine or coarse spray with the propellant in gaseous form, by foaming a liquid aerosol composition within an aerosol container prior to expulsion from the container, with the result that foamed aerosol composition is expelled from the container, which comprises bubbling a propellant gas into liquid aerosol composition in the container at a sufficient pressure and in a sufficient amount to foam the liquid aerosol composition while under confinement within the container, and then expelling the resulting foamed aerosol composition under propellant gas pressure within the container.

Preferred embodiments of the aerosol containers in accordance with the invention are illustrated in the drawings, in which.

Figure 1:
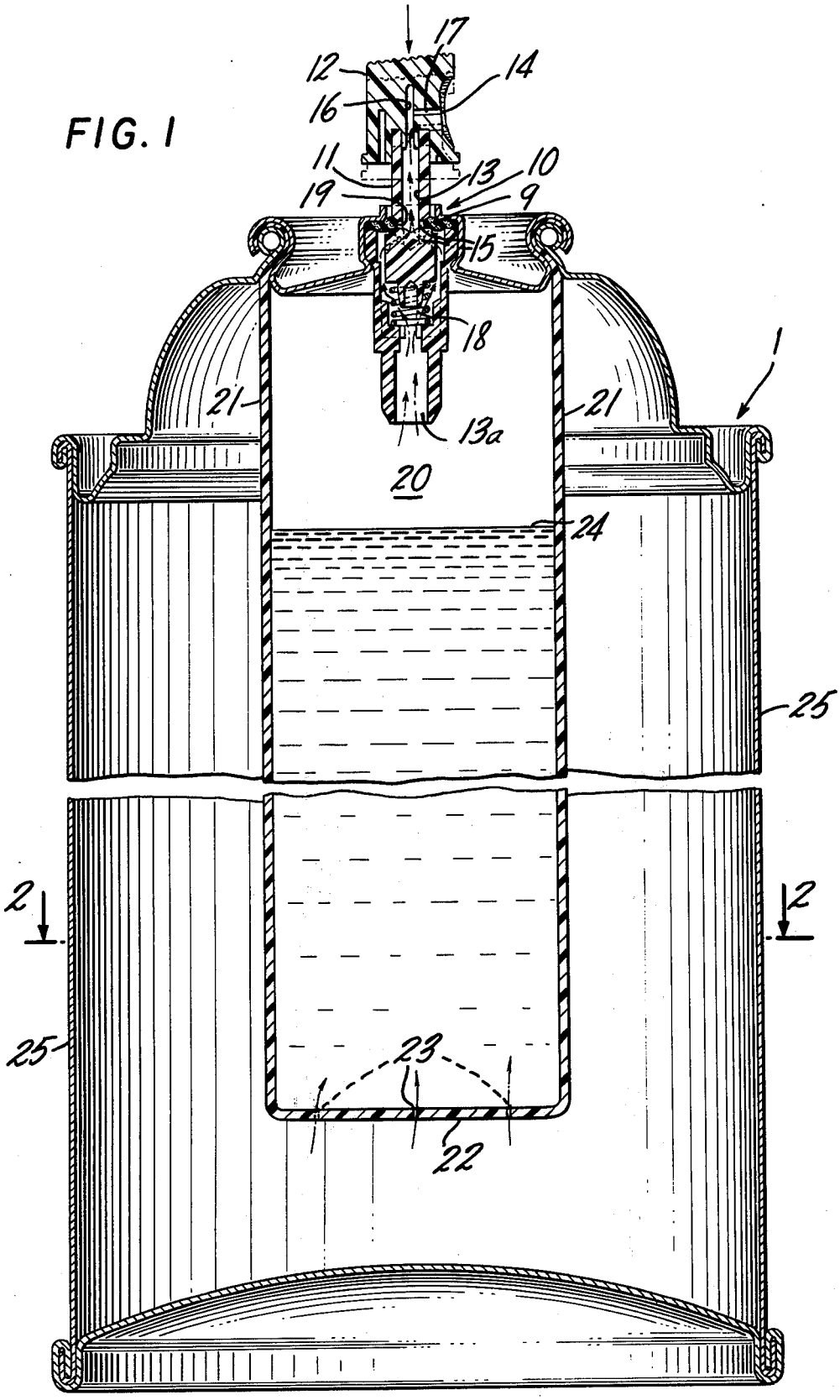
FIG. 1 represents a longitudinal sectional view of one embodiment of aerosol container in accordance with the invention, in which the porous bubbler is a perforated plate.

In principle, the aerosol containers of the invention utilize a container having at least two compartments, a foam compartment and a propellant gas compartment, separated by the porous bubbler, which is across the line of flow through the foam compartment to the valve delivery port from the propellant compartment. An aerosol composition to be foamed and then expelled from the container is placed in the first or foam compartment across the line of propellant gas flow via the porous bubbler to the valve and the propellant is placed in the second or propellant compartment on the other side of the porous bubbler. When the valve is opened, the propellant passes in gaseous form through the through pores of the porous bubbler, and foams the liquid aerosol composition in the foam compartment, or the porous bubbler or both at the same time propelling the foamed aerosol composition to and through the open valve passage out from the container.

The foam compartment between the porous bubbler and the valve provides the space needed for foam formation, and has a diameter considerably larger than the pores through the bubbler. The foam compartment can have a diameter from twice to 250,000 times, preferably from ten to 5,000 times, the pore diameter. The length of the foam compartment, i.e. the distance from the porous bubbler to the inlet end of the valve passage, is determined by the foam characteristics and whether it is desired to dispense a foam or a liquid or a mixture of the two. Consequently, the length of the foam compartment is not critical, but can be adjusted according to the desired size of the container. The overall dimensions of the bubbler and foam compartment are also selected according to the desired container size, and are not critical.

The porous bubbler whether located out of or in direct contact with propellant liquid ensures that the propellant gas, whether liquefied or not, enters as gas bubbles into the liquid aerosol composition to form a foam. The type of foam that is formed depends upon a number of variables, of which the most important are the foaming qualities of the liquid aerosol composition; the porosity and size of the pores of the porous bubbler, which determines the size of the gas bubbles released therefrom into the liquid aerosol composition; the height or depth of the layer of aerosol composition through which the bubbles must pass in order to reach the valve for expulsion from the container; the distance between the layer of aerosol composition and the valve; and the rate of formation, i.e., rate of bubbling, and relative stability of the foam, which can be controlled by pressure of propellant gas; size and number of bubble pores, and foam-stabilizers present in the liquid aerosol composition.

The formation of a foam is a highly dynamic process. When the foam is first formed, the walls of the foam bubbles (which are of liquid aerosol composition) are relatively thick. As the foam ages, liquid drains from the bubble walls, the walls become thinner, and eventually collapse. Since liquid drains from the top to the bottom of a compartment of foam, the bubble walls at the top of the foamed aerosol composition in the compartment are thinner than they are at the bottom. It is the top portion of the foamed aerosol composition that passes through the valve orifice in the aerosol containers of the invention, when the containers are held with the valve up. If the containers are held with the valve down, the reverse is true.

While the aerosol container valve is open, gas bubbles continuously pass thorugh the porous bubbler and enter the aerosol composition, to form a foam. At the same time, liquid drains from the foam as the foam progresses upwards, with the valve stem at the top, and the foam bubble walls start to break.

It will be apparent that if relatively large gas bubbles are passed slowly through a layer of aerosol liquid located relatively far from the valve, the foam must rise a considerable distance before reaching the valve, and if the foam drains rapidly and is unstable, the foam may collapse before it reaches the valve, and only gas will be expelled. This of course is undesirable.

At the other extreme, if the foam is formed rapidly, with small gas bubbles, the distance the foam must rise to reach the valve is short, and the foam is stable, and drains slowly, the resulting foam emerging from the valve will be relatively wet, and the droplet size relatively large. This could be acceptable, but in most cases the optimum is a condition somewhere between these two extremes and the length and diameter of the foam compartment, the porosity and pore size of the porous bubbler, the viscosity of the aerosol composition, and other variables are adjusted (usually by trial and error) to correct dimensions for the container, the compartments therein, and the porous bubbler to give the type of foam spray desired.

In general, with selection of the variables, satisfactory sprays can be obtained with aerosol compositions that form stable foams, unstable foams, and foams of intermediate stability. If the foam is unstable, the layer of aerosol liquid should be close to the valve, and the porous bubbler should have rather small pores, so that the liquid is foamed rapidly, with a plurality of small gas bubbles. A foam formed from small bubbles is more stable than one formed from large bubbles. If the required distance for foam to rise to reach the valve is short, the foam will reach the orifice of the valve and be expelled before the foam collapses.

On the other hand, if the liquid aerosol tends to give a stable foam, and a wet spray, it may be foamed with large gas bubbles, using a relatively coarse porous bubbler, which reduces the stability of the foam, and the distance of travel of the foam to the valve may be increased, using a longer container or a longer aerosol liquid composition compartment.

If only a small amount of aerosol liquid is available at a time to be foamed by a relatively large amount of gas, the foam will be relatively dry, and the resulting spray will be composed of small liquid droplets.

The foaming characteristics of the aerosol composition can be further modified by incorporating foam stabilizers, or defoamers, according to the relative foaming capability of the composition, and in addition its viscosity can be adjusted. More viscous compositions tend to form more stable foams than compositions of low viscosity.

The particular form of aerosol liquid is not critical. The aerosol conainers of the invention can foam aqueous aerosols, organic solvent solution aerosols, and emulsions, both of water-in-oil and oil-in-water type.

The stability of the foam is reduced when the propellant is soluble in the liquid aerosol composition. Also the greater the solubility of the propellant in the aerosol composition, the lower the efficiency of propellant utilization, since more of the propellant remains dissolved, and less is available for foaming the aerosol liquid within the container. Accordingly, it is generally preferred that the solubility of the propellant be at a minimum, and additions to the aerosol composition can be made to reduce solubility of the propellant therein. For instance, if the aerosol composition is an alcohol formulation, or employs any other water-soluble organic solvent, water may be added or the amount of water can be increased, so as to reduce the solubility of fluorocarbon and hydrocarbon propellants in the resulting solution. If the aerosol composition is an aqueous formulation, less soluble propellants, such as nitrogen, fluorocarbon and hydrocarbon propellants are preferred over the more soluble propellants, such as carbon dioxide, nitrous oxide, or dimethyl ether.

The aerosol containers in accordance with the invention can be made of metal or plastic, the latter being preferred for corrosion resistance. However, plastic-coated metal containers can also be used, to reduce corrosion. Aluminum, anodized aluminum, coated aluminum, zinc-plated and cadmium-plated steel, tin and acetal polymers such as Celcon or Delrin are suitable container materials.

Any type of porous material having through pores extending from one surface to the opposite surface can be used, including perforated plastic and metal sheets, wire screens, extruded plastic mesh, microporous membranes, nonwoven mats and mats of various fibrous materials, such as paper, polyethylene, polypropylene, acrylonitrile, polyvinyl chloride, polyvinylidene chloride, polyamides, polyesters, acetate rayon and viscose rayon, can be used. Porous sintered metal and plastic sheets and blocks, sintered glass sheets, and sintered ceramic sheets can also be used. Materials of the types designated as filter sheet materials often have the right pore size and porosity.

The bubbler can have pores whose diameters are within the range from about 0.1 micron to about 3 mm in diameter. The cross-sectional shape of the pore is not critical. The pores can be circular, elliptical, rectangular, polygonal, or any other irregular or regular shape in cross-section.

Large bubbler pores from large bubbles, and expel a relatively high ratio of propellant to liquid, and these are less efficient utilizers of propellant. Very small bubbler pores offer high resistance to gas flow, unless the bubblers are made very thin, as in the case of membrane filters. Since thin bubblers are relatively weak, supporting structures may be required which increase the cost of the container. The preferred bubbler pores have diameters within the range from about 0.01 mm to about 1 mm.

The bubbler should have an open area (as pore inlets or outlets) sufficient to provide a propellant gas flow to foam the aerosol composition for a given delivery of foam spray. Thus, the open area is determined by the amount of aerosol composition to be foamed, and the amount of the delivery. In general, the open area is not critical, and can be widely varied. However, it usually preferred that the open area be within the range from about 0.005 to about 10 $mm^2$, and still more preferably from about 0.01 to about 1 $mm^2$.

It is often advantageous to maintain liquid aerosol composition in the foam compartment of the container directly above the bubbler, out of contact with the remainder of the container. If the liquid is corrosive to metal, but economic and availability considerations require a metal outer container, the compartment in which the liquid is stored can then be of corrosion resistant plastic, with bubbler pores sufficiently small that the liquid does not drain out through the bubbler into the outer container.

The surface tension of the liquid and the pressure differential above and below the liquid operate against the force of gravity to restrain the liquid from flowing out of the compartment through the bubbler. However, the pressure differential can diminish or disappear, due to the lack of an absolute seal, or to gas diffusion through the walls of the container.

Surface forces can however prevent drainage through the bubbler. For example, the bubbler may be constructed of or surfaced with a material that is not wetted by the liquid. Wetting properties are affected by surfactants in the liquid. One can therefore assume perfect wetting by the liquid, i.e. zero contact angle, and reduce the bubbler to a pore size at which passage through the pores is impossible under the pressure and head conditions in the bubbler compartment, using the capillary rise equation $r=2\gamma/980\ h\Delta\rho$ where $r$ is the radius of the bubbler pore, $h$ is the height of liquid, $\Delta\rho$ is the difference in density between liquid and vapor, and $\gamma$ is the surface tension of the liquid.

Thus, if for example $\gamma = 30$ dynes/cm, $h = 10$ cm, and $\Delta\rho = 1$ gram/cc, then $r = 0.0066$ cm, and the bubbler pore diameter should not exceed 0.12 mm. If the other variables are the same, but the liquid height is only 1 cm, the bubbler orifice diameter can be increased to 1.2 mm without drainage.

The size of the bubbler pores is an important factor in determining the efficiency of the propellant. The smaller the bubbler pores, the less propellant required to expel a given amount of liquid. Provided the pores are sufficiently small, the number of pores will determine the rate of delivery of product. By relying on the number and size of bubbler pores to control the discharge rate, a less expensive valve of simple construction may be used. Valve orifices can be large, and thus valve clogging problems are avoided.

A porous material can be used to hold the liquid that is to be foamed at a fixed distance from the valve. Any material that is inert to the liquid and propellant can be used, such as a bed of sand, sintered metal, plastic or natural sponge, a woven or nonwoven fibrous mat, or a series of baffles or screens. Essential requirements are that the porous material contain through pores, that the voids volume be sufficient to hold and release as foam enough liquid for at least one normal spraying period, and that the gas transmission rate through the porous material should be large enough to ensure that enough gas is passed through to foam and propel a sufficient quantity of liquid aerosol composition per spray.

Aerosol spray compositions are used for a wide variety of different applications, each with different requirements. Thus, the required foam spray delivery of foamed aerosol composition can range from about 0.1 to about 1 ml. per second, with delivery periods ranging from 1 to 10 seconds per spraying. To ensure sufficient foamed aerosol composition for the required delivery, the total combined volume of the foam compartment and the porous bubbler should be sufficient to retain at least about 200% or more of the required amount of liquid aerosol composition to be delivered. Thus, the voids volume of the porous bubbler should be at least 0.2 ml. There is no upper limit, except that fixed by the size of the container. A practical upper limit for a 1 to 32 oz. container is from 10 ml. to 350 ml.

In general, from 20 to 200 ml. of gas measured at atmospheric pressure is required to foam and deliver 1 ml. of liquid. Thus, the flow requirement for the porous bubbler requires that it pass from about 2 to about 200 ml. of propellant gas per second. Assuming a pressure drop of one atmosphere, and a transmitting area of 1 square cm, for the smallest required gas flow rate (2 ml. per second) the gas transmission rate should not be less than $0.4 \times 10^{16}$. For the largest required gas flow rate (200 ml/sec.) the gas transmission rate should not be less than $40 \times 10^{16}$. The gas transmission rate is expressed as cubic centimeters of gas flow per 24 hour period across a square meter of transmitting surface at a pressure differential of one atmosphere.

The porous bubbler used to hold the liquid aerosol composition in the foam compartment at a fixed distance from the valve can serve both to hold the liquid and to provide pores through which propellant gas flows, to foam and expel the liquid. If the gas transmission rate through the porous bubbler corresponds to the required delivery rate for the product application, large valve orifices that do not restrict flow can be used. If the gas transmission rate is greater than required, flow may be reduced by using in combination with the porous bubbler either a porous material with restricted pores or a valve with small orifices.

The porous bubbler may serve as a barrier screening off the propellant gas compartment, and in this event the liquid aerosol composition can be stored in the first compartment between the porous bubbler and the valve without appreciable tendency to flow through into the propellant gas compartment due to surface tension forces and the lower pessure within the foam compartment. However, the pores of the bubbler can accept the aerosol composition, if desired, if these conditions are not adequate, and the composition will then flow through the pores with thee propellant gas. In this event, the aerosol composition can be stored in the second compartment with the propellant gas. The aerosol composition can even be foamed within the pores, if both the aerosol composition and propellant gas are present within the pores together. It will also be foamed if it is on one side of the porous bubbler, and the propellant gas bubbled through the bubbler emerges as bubbles beneath the surface of liquid aerosol on the other side of the bubbler.

If the aerosol composition is an aqueous composition, or in solution in a polar organic liquid, such as in aliphatic alcohol, and the propellant liquid is nonpolar, it may be advantageous to treat the porous bubbler so as to render its pores repellent to the aerosol composition. This will tend to keep the aerosol composition out of the pores of the porous bubbler, and maintain them open for passage of propellant gas therethrough. However, even if the pores of the bubbler become filled with aerosol composition, upon opening of the valve the pressure of propellant gas on the opposite side of the porous bubbler usually exceeds the bubble point of the bubbler so that the propellant gas has no difficulty in forcing any aerosol composition from the pores, and bubbling through to foam the aerosol composition.

Figure 2:
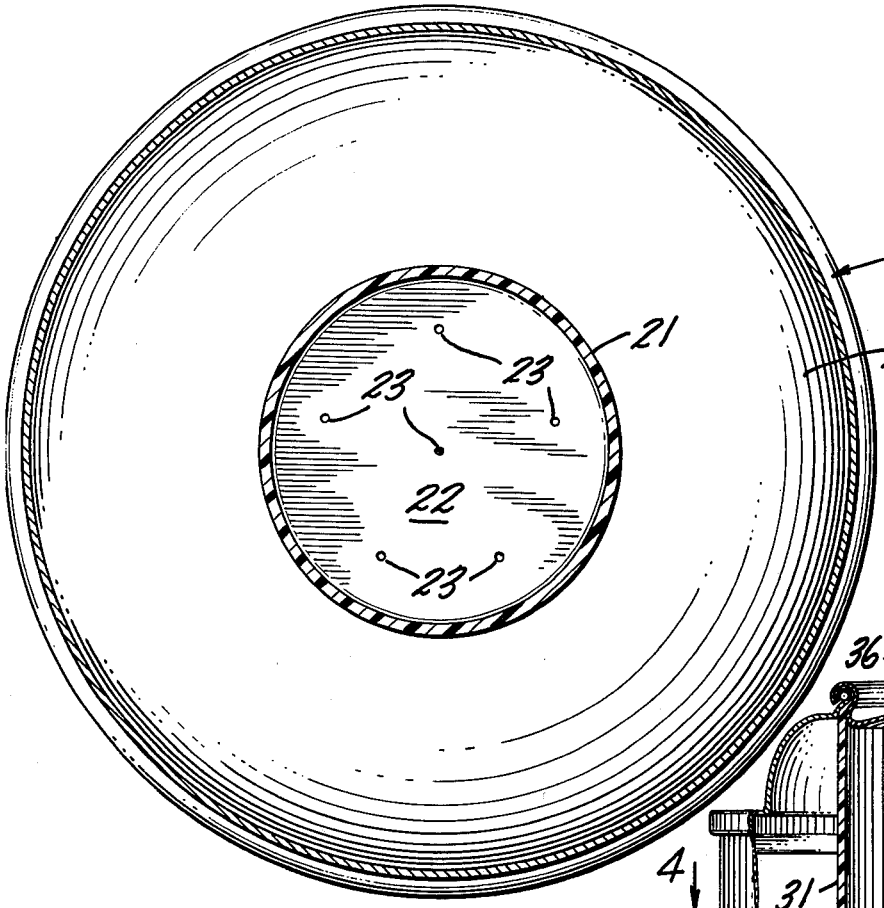
FIG. 2 represents a cross-sectional view taken along the line 2—2 of FIG. 1.

In the aerosol container shown in FIGS. 1 and 2, the aerosol valve 10 is of conventional type, with a valve stem 11 having a valve button 12 attached at one end and a flow passage 13 therethrough, in flow communication at one end via port 13a with the interior of a first grances and foods, since the liquefied propellants adversely affect both aroma and taste.

Another advantgeous feature is that hydrocarbon propellants, such as propane, cyclopropane, n-butane, and isobutane, can be used with aqueous solutions thereby avoiding the problem of flammability. Because of the high efficiency, the proportion of aqueous liquid to propellant gas expelled can always be high enough to produce a non-flammable spray, and this is the case when the container is held in any position.

Another advantageous feature is that smaller amounts of liquefied fluorocarbon propellant can be used to obtain the same quality of spray, as compared with conventional aerosol containers, resulting in an economy.

Having regard to the foregoing disclosure, the following is claimed as inventive and patentable embodiments thereof:

1. An aerosol container for foaming an aerosol composition therein prior to expulsion from the container, and then expelling the resulting foam, comprising, in combination, a pressurizable container having a valve movable between open and closed positions, with a valve stem, a foam-conveying passage therethrough and a delivery port in flow connection therewith; bias means for holding the valve in a closed position; and means for manipulating the valve against the bias means to an open position, for expulsion of aerosol foamed composition within the container via the valve passage and delivery port; means defining at least two separate compartments in the container, of which a first foam compartment is in direct flow connection with the valve passage, and a second propellant gas compartment is in flow connection with the valve passage only via the first foam compartment; and porous bubbler means interposed between and providing the only flow communication between the first and second compartments, and having a plurality of through pores communicating the compartments, the pores being of sufficiently small dimensions to restrict flow of propellant gas from the second compartment therethrough and form bubbles of such gas in liquid aerosol composition in the first foam compartment across the line of flow from the bubbler to the valve, thereby to foam the aerosol composition in the first foam compartment upon opening of the valve to atmospheric pressure, and to expel foamed aerosol composition through the open valve.

2. An aerosol container according to claim 1, in which the porous bubbler has pores of an average diameter within the range from about $0.1\mu$ to 3 mm.

3. An aerosol container according to claim 1, in which the porous bubbler has an open area within the range from about 0.005 to about 10 $mm^2$.

4. An aerosol container according to claim 1, in which the porous bubbler is a perforated sheet.

5. An aerosol container according to claim 1, in which the porous bubbler is a wire screen.

6. An aerosol container according to claim 1, in which the porous bubbler is a microporous membrane.

7. An aerosol container according to claim 1, in which the porous bubbler is a sheet of nonwoven fibrous material.

8. An aerosol container according to claim 1, in which the porous bubbler is a sheet of sintered particulate material.

9. An aerosol container according to claim 1, in which the porous bubbler is a filter sheet material.

10. An aerosol container according to claim 1, in which the container is cylindrical, with the valve at one end, and the means defining the first compartment comprises a concentric inner cylinder spaced from the walls of the container surrounding and extending from the valve, and the porous bubbler closes off the other end of the inner cylinder, the remainder of the interior of the aerosol container outside the walls and bottom of the inner cylinder comprising the second annular compartment.

11. An aerosol container according to claim 10, in which the porous bubbler is a perforated plate.

12. An aerosol container according to claim 10, in which the porous bubbler is a sheet of nonwoven fibrous material.

13. An aerosol container according to claim 1, comprising a wick extending into the second compartment from the porous bubbler.

14. An aerosol container according to claim 1, comprising two porous bubblers, one interposed at one end of the first compartment and one interposed in the first compartment adjacent the valve, both being across the line of flow through the first compartment to the valve.

15. A process for foaming a liquid aerosol composition within an aerosol container prior to expulsion from the container, with the result that a foamed aerosol composition is expelled from the container, comprising bubbling a propellant gas into liquid aerosol composition in the container at a sufficient pressure and in a sufficient amount to foam the liquid aerosol composition while under confinement within the container, and then expelling the resulting foamed aerosol composition under propellant gas pressure within the container.

16. A process according to claim 15, which comprises passing the propellant gas through a porous bubbler into the aerosol composition to be foamed and then expelled from the container.

17. A process according to claim 16, in which the porous bubbler has pores of an average diameter within the range from about 0.01 mm to about 3 mm.

18. A process according to claim 16, in which the porous bubbler has an open area within the range from about 0.005 to about 10 $mm^2$.

19. A process according to claim 15 in which the propellant gas is stored under pressure in liquefied form in the container, but when the valve orifice is opened and pressure reduced a proportion of liquefied propellant is volatilized to gas form and bubbled into liquid aerosol composition to form a foam.

20. A process according to claim 15, in which the propellant gas is stored under pressure in gaseous form in the container, but when the valve orifice is opened and pressure reduced a proportion of propellant is bubbled into liquid aerosol composition to form a foam.

21. A process according to claim 15, in which the valve orifice is sufficiently large that a proportion of the foamed aerosol composition dispensed therethrough is in the form of a foam.

22. A process according to claim 15, in which the valve orifice is sufficiently large that a proportion of the foamed aerosol composition dispensed therethrough is in the form of mixed foam and liquid droplets.

23. A process according to claim 15, in which the foamed aerosol composition is dispensed in the form of a liquid spray comprising liquid droplets.

24. A process according to claim 15, in which the aerosol composition is an aqueous composition.

foam compartment 20 of the container 1, defined by side walls 21, and a perforated plate bottom 22 with six passages or apertures 23, 100$\mu$ in diameter, constituting a porous bubbler. The valve passage 13 is open at the other end at port 14 via button passages 16 to delivery orifice 17. The valve button 12 is manually moved against the coil spring 18 between open and closed positions. In the closed position, shown in FIG. 1, the valve port 15 is closed, seated against the inner periphery 19 of ring 9, serving as a valve seat. In the open position (shown in dashed lines), the valve stem is depressed by pushing in button 12, so that port 15 is exposed, and the contents of the compartment 20 are free to pass through the valve passages 13, 16 out the delivery orifice 17.

The remainder of the interior of the aerosol container 1 outside the walls 21 and bottom 22 of the foam compartment 20 constitutes a second annular compartment propellant 25 surrounding the first. The second compartment 25 is filled with propellant, which can be either liquefied propellant, such as a hydrocarbon or fluorocarbon, or propellant gas. The foam compartment 20 is adapted to be filled with aerosol composition to the level 24, as indicated. The aerosol composition, because of the small size of the openings 23 in the plate 22, the propellant pressure in compartment 25, and the relatively high viscosity of the aerosol composition, shows no tendency to pass through the openings 23 into the compartment 25 in which the propellant is stored.

In operation, button 12 is depressed, so that the valve is manipulated to the open position. The propellant gas passes through the openings 23 in plate 22 and bubbles into the compartment 20, where it foams the aerosol composition there, and then expels the foamed aerosol composition through the passages 13, 16, leaving the container via orifice 17 of the valve as a fine spray.

Figure 3:
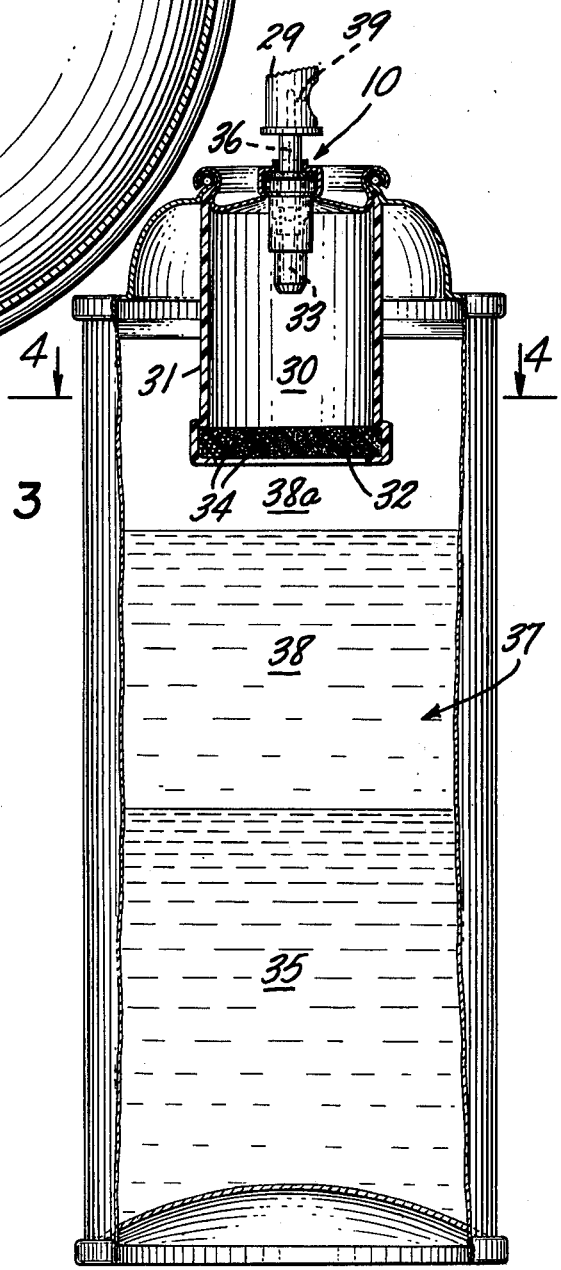
FIG. 3 represents a longitudinal sectional view of another embodiment of aerosol container in accordance with the invention, in which the porous bubbler is a filter material, in the form of a nonwoven mat of fibers.
Figure 4:
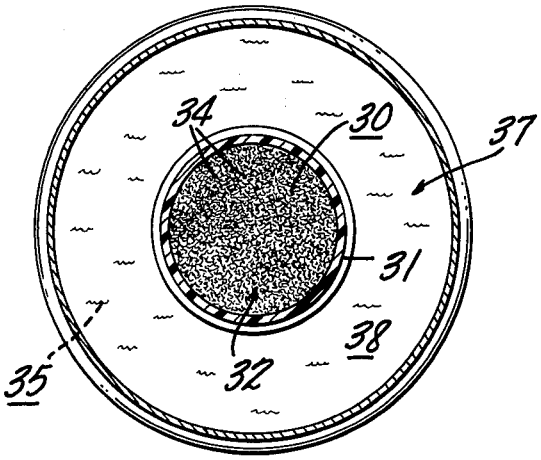
FIG. 4 represents a cross-sectional view taken along the line 4—4 of FIG. 3.

The aerosol container in FIGS. 3 and 4 has a valve similar in construction to that of FIGS. 1 and 2, with a considerably smaller compartment 30 defined by the walls 31 and the porous mat 32 of nonwoven material in direct flow communication with the valve passages 33, 36 and delivery orifice 39. The mat 32 has rather large pores 34, from 0.1 to 1 mm in diameter, through which both aerosol composition 35, stored at the bottom of the second compartment 37 of the container, and gas volatilized from propellant liquid 38, stored in a layer 38*a* above the aerosol composition, can pass.

In use, the container is shaken, so that aerosol composition will be taken up in the mat 32, filling the pores 34 with liquid aerosol. The valve is then opened by depressing button 29. Propellant gas from the layer 38*a* above the liquid aerosol 35 in the second compartment 37 then passes through the mat 32, driving the liquid aerosol out of the pores 34, while simultaneously foaming the liquid aerosol, passing the foam through foam compartment 30, and expelling it through the open valve, so that the foamed aerosol composition is delivered from the container via orifice 39 as a fine spray.

Figure 5:
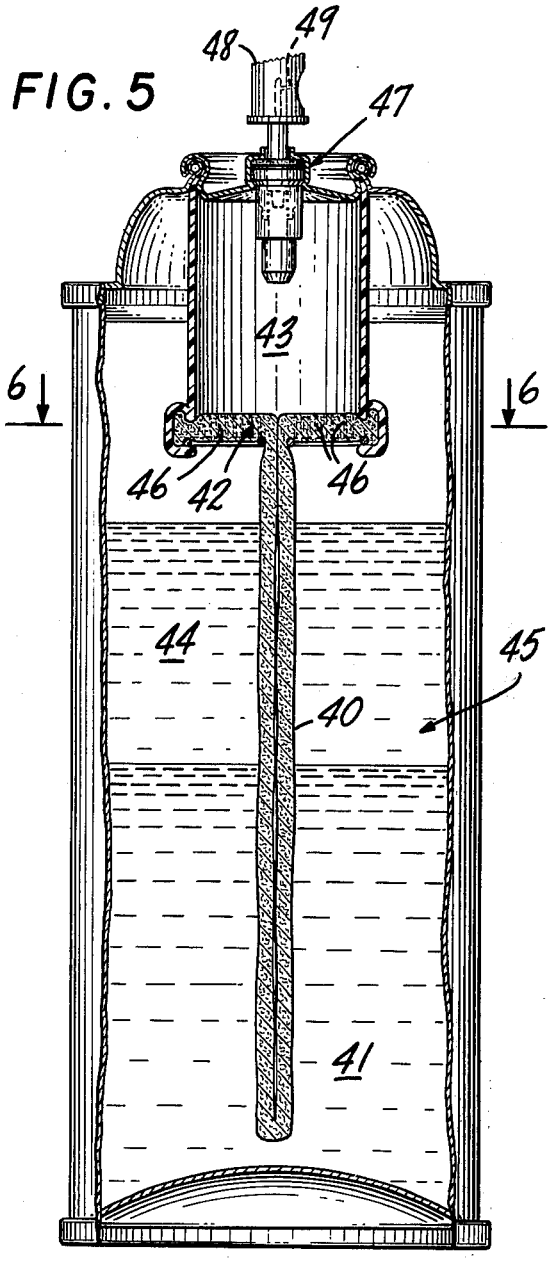
FIG. 5 represents a longitudinal sectional view of another embodiment of aerosol container in accordance with the invention, in which the porous bubbler comprises a filter sheet material provided with a wick.
Figure 6:
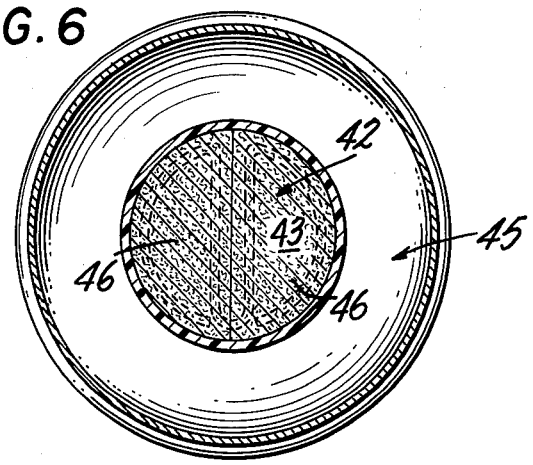
FIG. 6 represents a cross-sectional view taken along the line 6—6 of FIG. 5.

The aerosol container shown in FIGS. 5 and 6 is similar to that of FIGS. 3 and 4 with the exception that the mat 42 is now provided with a wick 40, which extends into the layer 41 of aerosol composition at the bottom of the second compartment 45 of the container. The wick 40 ensures that the aerosol composition is borne upwardly from layer 41 through the propellant layer 44 by capillarity to the mat 42, and saturates the mat pores 46 at all times. Because of the wick, it is not necessary to invert or shake the container to saturate the mat with liquid. All that is necessary is that the valve 47 be opened by pushing on button 48, whereupon the propellant gas in the second compartment 45 will expel the liquid from the pores 46 of the mat, and foam it, driving the foam through the foam compartment 43 to and through the valve, and delivering a spray of foamed aerosol composition via orifice 49 from the container.

Figure 7:
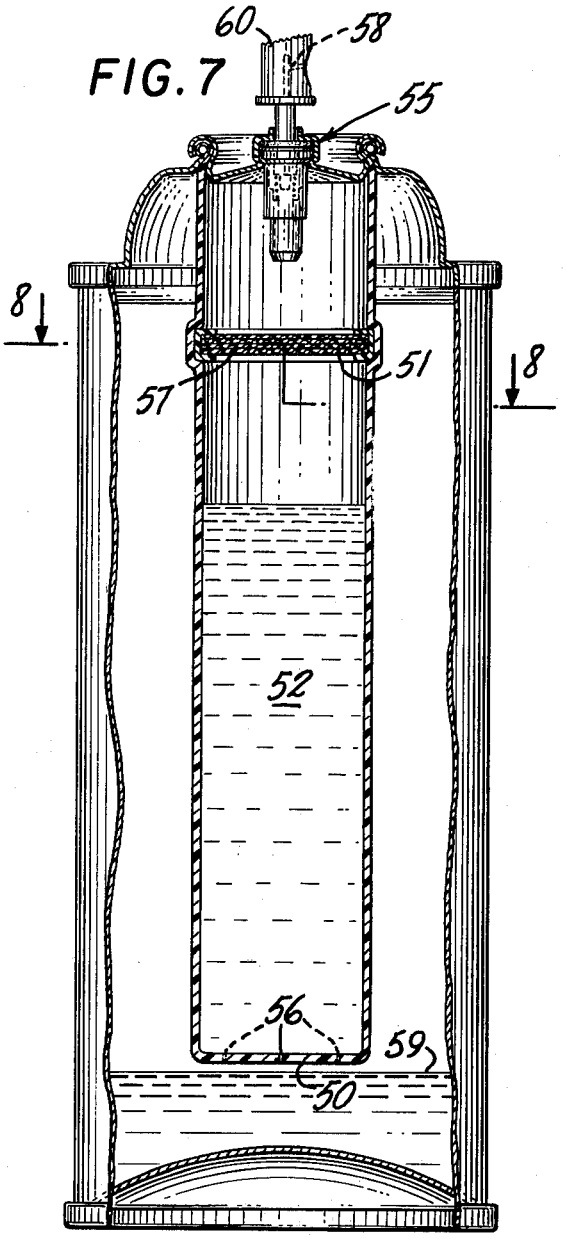
FIG. 7 represents a longitudinal sectional view of another embodiment of aerosol container in accordance with the invention, in which two porous bubblers are provided.
Figure 8:
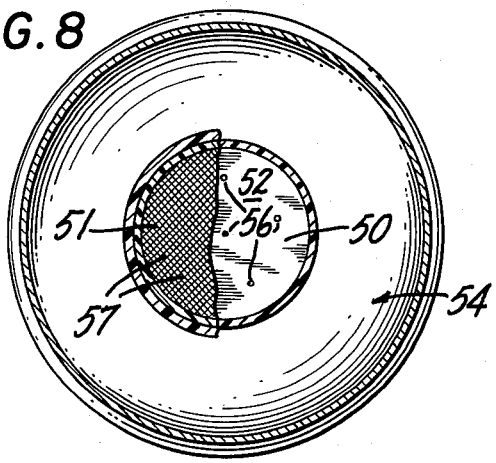
FIG. 8 represents a cross-sectional view taken along the line 8—8 of FIG. 7.

The aerosol container of FIGS. 7 and 8 is similar to that of FIGS. 1 and 2 but with two porous bubblers 50 and 51, interposed at each end of the inner compartment 52 of the container. The first bubbler 50 is in the form of a perforated plate similar to that of FIGS. 1 and 2, and the second bubbler 51 is an absorbent mat, of the type of FIGS. 3 and 4.

The liquid aerosol composition is retained in the inner compartment 52 to the level shown above the perforated plate 50. Propellant gas in liquefied form is retained in the second compartment 54, outside the first, to the level 59 shown.

When the valve button 60 is depressed and the valve 55 brought to the open position, liquefied propellant volatilizes, and passes in gaseous form through the openings 56 of the perforated plate 50, foaming the liquid in the compartment 52, and driving it upwardly to the absorbent mat 51. The absorbent mat 51 also has a liquid filling the pores 57, and the propellant gas drives this liquid out of the pores, and foams this liquid as well, with the result that a fine spray of foamed aerosol composition is delivered via the valve delivery port 58 while the valve is open.

The aerosol containers and the process of the instant invention can be used to deliver any aerosol composition in the form of a spray. It is particularly suited for use with aqueous solutions, since these are readily compounded to produce a foam. However, any liquid aerosol composition can be foamed, and the container can be used for any liquid aerosol composition. The range of products that can be dispensed by this aerosol container is diverse, and includes pharmaceuticals for spraying directly into oral, nasal and vaginal passages; antiperspirants; hair sprays, fragrances and flavors; body oils; insecticides; window cleaners and other cleaners; spray starches; and polishes for autos, furniture and shoes.

A particularly advantageous feature is that the spray that is delivered does not feel cold, but feels that it is at ambient temperature, unlike conventional aerosol containers, which deliver cold sprays. This is of particular importance where product delivery is to sensitive membranes areas, such as oral, nasal and vaginal passages, where the coldness of the spray can produce irritation. It is also important in applications to the skin, where the sprays that do not feel cold are more comfortable.

Another particularly advantageous feature is that compressed gases, such as nitrogen or air, can be used. This is possible because of both the high efficiency of utilization of propellant and the fact that a foamed aerosol composition can be delivered from the container when operated in any position, so that loss of compressed gas through misuse is avoided. The use of pharmacologically inert gases such as nitrogen or air to deliver medicinals to sick people is of particular importance, since liquefied propellants are known to have a pharmacological effect. The use of compressed gases, particularly nitrogen, is also advantageous with frameans defining at least two separate compartments in the container of which a first foam compartment containing liquid aerosol composition to be foamed and expelled is in direct flow connection with the valve passage, and a second propellant compartment containing propellant and outside the first compartment is in flow connection with the valve passge only via the first compartment; substantially all of the liquid aerosol composition to be foamed being retained in the first compartment, and substantially all of the propellant being retained in the second compartment; and porous bubbler means having through pores interposed between the first and second compartments with the through pores communicating the compartments, the pores being of sufficiently small dimensions to restrict flow of propellant from the second compartment therethrough and form bubbles of propellant gas in liquid aerosol composition across the line of flow from the bubbler to the valve, thereby to foam the aerosol composition in the first compartment upon opening of the valve to atmospheric pressure, and to expel foamed aerosol composition through the open valve.

44. An aerosol container for foaming an aerosol composition therein prior to expulsion from the container, and then expelling the resulting foam, comprising, in combination, a pressurizable container having a valve movable between open and closed positions, with a valve stem, a foam-conveying passage therethrough and a delivery port in flow connection therewith; bias means for holding the valve in a closed position; and means for manipulating the valve against the bias means to an open position, for expulsion of aerosol foamed composition within the container via the valve passage and delivery port; means defining at least two separate compartments in the container, of which a first foam compartment is in direct flow connection with the valve passage, and a second compartment is in flow connection with the valve passage only via the first compartment; and porous bubbler means having through pores interposed between the first foam compartment to the valve with the through pores communicating the compartments; the porous bubbler retaining within its pores liquid aerosol composition to be foamed and expelled; and the pores being of sufficiently small dimensions to restrict flow of propellant gas from the second compartment therethrough and form bubbles of such gas in liquid aerosol composition, thereby to foam the aerosol composition upon opening of the valve to atmospheric pressure, and to expel foamed aerosol composition through the open valve.

45. An aerosol container according to claim 44, in which liquid aerosol composition and propellant are retained in the second compartment.

46. An aerosol container according to claim 44, in which the porous bubbler has pores of an average diameter within the range from about $0.1\mu$ to about 3 mm.

47. An aerosol container according to claim 44, in which the porous bubbler has an open area within the range from about 0.005 to about 10 $mm^2$.

48. An aerosol container according to claim 44, in which the porous bubbler is a sheet of nonwoven fibrous material.

49. An aerosol container according to claim 44, in which the porous bubbler is a sheet of sintered particulate material.

50. An aerosol container according to claim 44, in which the container is cylindrical, with the valve at one end, and the means defining the first compartment comprises a concentric inner cylinder spaced from the walls of the container surrounding and extending from the valve, and the porous bubbler closes off the other end of the inner cylinder, the remainder of the interior of the aerosol container outside the walls and bottom of the inner cylinder comprising the second annular compartment.

51. An aerosol container according to claim 44, in which the porous bubbler is a sheet of nonwoven fibrous material.

* * * * *

25. A process according to claim 24, in which the aqueous composition comprises a foam stabilizing agent.

26. A process according to claim 24, in which the aqueous composition comprises a defoamer.

27. An aerosol container for foaming an aerosol composition therein prior to expulsion from the container, and then expelling the resulting foam, comprising, in combination, a pressurizable container having a valve movable between open and closed positions, with a valve stem, a foam conveying passage therethrough and a delivery port in flow connection therewith; bias means for holding the valve in a closed position; and means for manipulating the valve against the bias means to an open position, for expulsion of aerosol foamed composition within the container via the valve passage and delivery port; means defining at least two separate compartments in the container of which a first compartment is in direct flow connection with the valve passage, and a second compartment is in flow connection with the valve passage only via the first compartment; and porous bubbler means having through pores interposed between the first and second compartments with the through pores communicating the compartments, the pores being of sufficiently small dimensions to restrict flow of propellant gas from the second compartment therethrough and form bubbles of such gas in liquid aerosol composition across the line of flow from the bubbler to the valve, thereby to foam the aerosol composition upon opening of the valve to atmospheric pressure, and to expel foamed aerosol composition through the open valve, and a wick extending into the second compartment from the porous bubbler.

28. An aerosol container according to claim 27, in which the container is cylindrical, with the valve at one end, and the means defining the first compartment comprises a concentric inner cylinder spaced from the walls of the container surrounding and extending from the valve, and the porous bubbler closes off the other end of the inner cylinder, the remainder of the interior of the aerosol container outside the walls and bottom of the inner cylinder comprising the second annular compartment.

29. An aerosol container according to claim 27, in which the porous bubbler is a sheet of nonwoven fibrous material.

30. An aerosol container according to claim 29, in which the porous bubbler has pores of an average diameter within the range from about 0.1$\mu$ to about 3 mm.

31. An aerosol container according to claim 29, in which the porous bubbler has an open area within the range from about 0.005 to about 10 mm$^2$.

32. An aerosol container according to claim 29, in which the porous bubbler is a perforated sheet.

33. An aerosol container according to claim 29, in which the porous bubbler is a wire screen.

34. An aerosol container according to claim 29, in which the porous bubbler is a microporous membrane.

35. An aerosol container according to claim 29, in which the porous bubbler is a sheeet of nonwoven fibrous material.

36. An aerosol container according to claim 29, in which the porous bubbler is a sheet of sintered particulate material.

37. An aerosol container according to claim 29, in which the porous bubbler is a filter sheet material.

38. An aerosol container according to claim 29, in which the container is cylindrical, with the valve at one end, and the means defining the first compartment comprises a concentric inner cylinder spaced from the walls of the container surrounding and extending from the valve, and the porous bubbler closes off the other end of the inner cylinder, the remainder of the interior of the aerosol container outside the walls and bottom of the inner cylinder comprising the second annular compartment.

39. An aerosol container according to claim 29, in which the porous bubbler is a perforated plate.

40. An aerosol container according to claim 29, in which the porous bubbler is a sheet of nonwoven fibrous material.

41. An aerosol container for foaming an aerosol composition therein prior to expulsion from the container, and then expelling the resulting foam, comprising, in combination, a pressurizable container having a valve movable between open and closed positions, with a valve stem, a foam-conveying passage therethrough and a delivery port in flow connection therewith; bias means for holding the valve in a closed position; and means for manipulating the valve against the bias means to an open position, for expulsion of aerosol foamed composition within the container via the valve passage and delivery port; means defining at least two separate compartments in the container, of which a first compartment is in direct flow connection with the valve passage, and a second compartment is in flow connection with the valve passage only via the first compartment; two porous bubbler means, one interposed at one end of the first foam compartment and one interposed in the first foam compartment adjacen the valve, both being across the line of flow through the first foam compartment to the valve; each porous bubbler means having through pores, the first mentioned porous bubbler means being interposed between the first and second compartments with the through pores communicating the compartments, the pores being of sufficiently small dimensions to restrict flow of propellant gas from the second compartment therethrough and form bubbles of such gas in liquid aerosol composition across the line of flow from the bubbler to the valve, thereby to foam the aerosol composition upon opening of the valve to atmospheric pressure, and to expel foamed aerosol composition through the open valve.

42. An aerosom container according to claim 41, in which the container is cylindrical, with the valve at one end, and the means defining the first compartment comprises a concentric inner cylinder spaced from the walls of the container surrounding and extending from the valve, and the porous bubbler closes off the other end of the inner cylinder, the remainder of the interior of the aerosol container outside the walls and bottom of the inner cylinder comprising the second annular compartment.

43. An aerosol container for foaming an aerosol composition therein prior to expulsion from the container, and then expelling the resulting foam, comprising, in combination, a pressurizable container having a valve movable between open and closed positions, with a valve stem, a foam-conveying passage therethrough and a delivery port in flow connection therewith; bias means for holding the valve in a closed position, for expulsion of aerosol foamed composition within the container via the valve passage and delivery port;

UNITED STATES PATENT OFFICE

CERTIFICATE OF CORRECTION

Patent No. 3,970,219 Dated July 20, 1976

Inventor(s) J. George Spitzer et al.

It is certified that error appears in the above-identified patent and that said Letters Patent are hereby corrected as shown below:

| | | |
|---|---|---|
| Column 1, line 35 | : | "Abphanalp" should be --Abplanalp-- |
| line 53 | : | "peopellant" should be --propellant-- |
| Column 2, line 13 | : | "in" should be --In-- |
| Column 6, line 44 | : | "from" should be --form-- |
| Column 8, line 35 | : | "pessure" should be --pressure-- |
| line 39 | : | "thee" should be --the-- |
| Column 11 line 51 | : | add --about-- before "3 mm" |
| Column 14 line 34 | : | "adjacen" should be --adjacent-- |
| Column 14 line 49 | : | "aerosom" should be --aerosol-- |

Signed and Sealed this

First Day of February 1977

[SEAL]

*Attest:*

RUTH C. MASON
*Attesting Officer*

C. MARSHALL DANN
*Commissioner of Patents and Trademarks*